US007669668B2

(12) United States Patent
Martinez et al.

(10) Patent No.: US 7,669,668 B2
(45) Date of Patent: Mar. 2, 2010

(54) SYSTEM, APPARATUS, AND METHOD OF CONDUCTING MEASUREMENTS OF A BOREHOLE

(75) Inventors: Ruben Martinez, Houston, TX (US); Jan Smits, Sugar Land, TX (US); Reza Taherian, Sugar Land, TX (US); Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 637 days.

(21) Appl. No.: 11/018,340

(22) Filed: Dec. 20, 2004

(65) Prior Publication Data

US 2006/0113111 A1 Jun. 1, 2006

Related U.S. Application Data

(60) Provisional application No. 60/632,564, filed on Dec. 1, 2004.

(51) Int. Cl.
*E21B 47/01* (2006.01)
*E21B 47/08* (2006.01)

(52) U.S. Cl. ..... 175/40; 175/45; 73/152.46

(58) Field of Classification Search ..... 166/61, 166/40, 45; 33/544.2, 544.3, 544.5; 73/152.02, 73/152.46

See application file for complete search history.

(56) References Cited

U.S. PATENT DOCUMENTS 3,092,188 A 6/1963 Farris et al.
3,183,600 A 5/1965 Jay
3,944,910 A 3/1976 Rau
3,977,468 A 8/1976 Brewer et al.
4,052,662 A 10/1977 Rau
4,063,151 A 12/1977 Suau et al.
4,077,003 A 2/1978 Rau
4,151,457 A 4/1979 Rau
4,251,921 A 2/1981 Fink
4,300,098 A 11/1981 Huchital et al.
4,324,297 A * 4/1982 Denison ..... 175/45
4,416,339 A 11/1983 Baker et al.

(Continued)

OTHER PUBLICATIONS

Gasulla, Manel et al., "A Contactless Capacitive Angular-Position Sensor," IEEE Sensors Journal vol. 3, No. 5, Oct. 2003, pp. 607-614.

*Primary Examiner*—Jennifer H Gay
*Assistant Examiner*—David Andrews
(74) *Attorney, Agent, or Firm*—Darla Fonseca; Brigitte L. Echols; Charlotte Rutherford

(57) ABSTRACT

A method is provided for conducting measurements of a borehole while drilling the borehole in a geological formation. First, a rotatable drilling assembly is provided that has, at a forward end, a drill bit and a borehole measurement tool connected rearward of the drill bit. The measurement tool includes at least one caliper arm extendible outward from the measurement tool. The method involves drilling the borehole by operating the rotatable drilling assembly. While drilling, the wall of the borehole is contacted with at least one extendable caliper arm of the borehole measurement tool and the extension of the caliper arm contacting the borehole wall is measured, thereby determining a distance between the measurement tool and the borehole wall. During rotation of the drilling assembly, contact is maintained between the caliper arm and the borehole wall and the measuring step is repeated at multiple positions of the drilling assembly.

25 Claims, 3 Drawing Sheets

U.S. PATENT DOCUMENTS 4,525,815 A 6/1985 Watson
4,652,829 A 3/1987 Safinya
4,689,572 A 8/1987 Clark
4,704,581 A 11/1987 Clark
4,765,183 A * 8/1988 Coury ..... 73/152.03
4,814,609 A 3/1989 Wraight et al.
4,845,359 A 7/1989 Wraight
4,879,463 A 11/1989 Wraight et al.
4,914,826 A 4/1990 Nold, III
5,017,778 A 5/1991 Wraight
5,092,056 A 3/1992 Deaton
5,210,495 A 5/1993 Hapashy et al.
5,242,020 A * 9/1993 Cobern ..... 166/254.2
5,243,290 A 9/1993 Safinya et al.
5,250,806 A 10/1993 Rhein-Knudsen et al.
5,345,179 A 9/1994 Habashy et al.
5,397,893 A 3/1995 Minette
5,406,206 A 4/1995 Safinya et al.
5,434,507 A 7/1995 Beren et al.
5,469,736 A 11/1995 Moake
5,473,158 A 12/1995 Holenka et al.
5,513,528 A 5/1996 Holenka et al.
5,520,255 A 5/1996 Barr et al.
5,565,624 A 10/1996 Deboaisne et al.
5,574,371 A 11/1996 Tabanou et al.
5,685,379 A 11/1997 Barr et al.
5,886,303 A 3/1999 Rodney
6,065,219 A * 5/2000 Murphey et al. ..... 33/544
6,116,355 A 9/2000 Colebrook
6,158,529 A * 12/2000 Dorel ..... 175/61
6,173,793 B1 1/2001 Thompson et al.
6,191,588 B1 2/2001 Chen
6,285,026 B1 9/2001 Evans et al.
6,384,605 B1 5/2002 Li
6,467,341 B1 * 10/2002 Boucher et al. ..... 73/152.43
6,552,334 B2 4/2003 Ellis et al.
6,560,889 B1 5/2003 Lechen
6,600,321 B2 * 7/2003 Evans ..... 324/369
6,648,083 B2 11/2003 Evans et al.
2002/0108487 A1 8/2002 Yuratich et al.

* cited by examiner

SYSTEM, APPARATUS, AND METHOD OF CONDUCTING MEASUREMENTS OF A BOREHOLE

CROSS-REFERENCE TO RELATED APPLICATIONS

This invention claims priority pursuant to 35 U.S.C. § 119 of U.S. provisional patent application Ser. No. 60/632,564, filed on Dec. 1, 2004. This provisional application is hereby incorporated by reference in its entirety.

BACKGROUND OF THE INVENTION

Field of the Invention

The present invention relates generally to a system, apparatus, and method of conducting measurements of a borehole penetrating a geological formation. More particularly, the system, apparatus and/or method relates to conducting measurements of the borehole, such as borehole caliper profile and preferably while drilling.

The collection of data on downhole conditions and movement of the drilling assembly during the drilling operation is referred to as measurement-while-drilling ("MWD") techniques. Similar techniques focusing more on the measurement of formation parameters than on movement of the drilling assembly are referred to as logging-while-drilling ("LWD") techniques. The terms "MWD" and "LWD" are often used interchangeably, and the use of either term in the present disclosure should be understood to include the collection of formation and borehole information, as well as of data on movement of the drilling assembly. The present invention is particularly suited for use with both MWD and LWD techniques.

Measurements of the subject borehole are important in the measurement of the parameters of the formation being penetrated and in the drilling of the borehole itself. Specifically, measurements of borehole shape and size are useful in a number of logging or measurement applications. For example, it is known to measure the diameter, also known as the caliper, of a borehole to correct formation measurements that are sensitive to size or standoff.

The prior art provides wellbore caliper devices for making these borehole measurements. These devices include the wireline tools described in U.S. Pat. Nos. 3,183,600, 4,251,921, 5,565,624, and 6,560,889. For example, the '921 patent describes a wireline tool having a tool body equipped with caliper arms that can be extended outward to contact the wall of the borehole. The wireline tool employs potentiometers that are responsive to extension of the caliper arms, thereby allowing for measurement of the arms' extension. Each of the above patent publications is hereby incorporated by reference for all purposes and made a part of the present disclosure.

Indirect techniques of determining borehole diameters have also been employed. For example, acoustic devices are employed to transmit ultrasonic pressure waves toward the borehole wall, and to measure the time lag and attenuation of the wave reflected from the borehole, thereby measuring the distance between the drilling tool and the borehole wall. For more detailed description of such prior art, references may be made to U.S. Pat. Nos. 5,397,893, 5,469,736, and 5,886,303.

The prior art further includes devices that obtain indirect caliper measurements from formation evaluation ("FE") measurements. The response of sensors is modeled with the standoff as one of the variables in the model response (along with the formation property of primary interest). This is typically done to correct the FE measurement for the effect of sensor standoff. The standoff measurement is therefore obtained indirectly and as a byproduct of the processing of the response data. Examples of such devices are discussed in U.S. Pat. Nos. 6,384,605, 6,285,026, and 6,552,334.

SUMMARY OF THE INVENTION

In one aspect of the present invention, a method is provided for conducting measurements of a borehole while drilling the borehole in a geological formation. The method includes the step of providing a rotatable drilling assembly having thereon, at a forward end, a drill bit and a borehole measurement tool connected rearward of the drill bit. The measurement tool includes at least one caliper arm extendible outward from the measurement tool. The method involves drilling the borehole by operating the rotatable drilling assembly. While drilling, the wall of the borehole is contacted with at least one extendable caliper arm of the borehole measurement tool and the extension of the caliper arm contacting the borehole wall is measured, thereby determining a distance between the measurement tool and the borehole wall. The method repeats the contacting and measuring steps at multiple positions of the drilling assembly during drilling. Preferably, the drilling step includes maintaining contact between the caliper arms and the borehole wall during rotation of the drilling assembly.

Preferably, the contacting and measuring steps are performed at a plurality of angular positions of the drilling assembly, and the method further involves determining the angular orientation of the drilling assembly relative to the borehole for each measurement of the extension of the caliper arm (e.g., using a pair of magnetometers). Most preferably, the lateral position of the measurement tool in the borehole is also detected for each measurement of the extension of the caliper arm. For example, the detecting step may include measuring the lateral accelerations of the drilling assembly (e.g., using a pair of accelerometers) during drilling and deriving, from the measurements of lateral acceleration, the lateral positions of the borehole measurement tool.

In another aspect of the invention, a borehole measurement apparatus is provided in a rotatable drilling assembly for drilling a borehole penetrating a geological formation. The borehole measurement apparatus includes a support body integrated with the drilling assembly and rotatably movable therewith. The apparatus also includes at least one caliper arm (in some applications, two or more arms), that is mounted to the support body and extendable therefrom to contact the borehole wall during drilling. Furthermore, a sensor is provided and positioned proximate the caliper arm and is operable to detect the distance between the extended arm and the support body. The caliper arm preferably includes a driving element positioned to urge the caliper arm radially outward from said body. The driving element may include a spring positioned to urge the caliper arm radially outward to contact the borehole wall. Alternatively, the driving element may include a hydraulic actuator positioned to urge the caliper arm radially outward to contact the borehole wall.

Preferably, the apparatus includes a sensing device operatively associated with the body to detect the angular orientation of the support body relative to the borehole wall and a sensing device operatively associated with the support body to detect the lateral position of the support body (i.e., the measurement apparatus) relative to the borehole. In one embodiment, the sensing device includes a pair of accelerometers positioned in generally perpendicular relation on a plane generally perpendicular to the longitudinal axis of the drilling assembly. The accelerometers are positioned to detect the lateral accelerations of the support body (from which the lateral positions of the drilling assembly may be derived). In another embodiment, a pair of magnetometers is positioned to detect the orientation of the support body with respect to the earth's magnetic field. The pair of magnetometers is positioned in generally perpendicular relation on a plane that is generally perpendicular to the longitudinal axis of the support body.

In yet another aspect of the present invention, a steerable rotary drilling assembly is provided for drilling a borehole penetrating a geological formation. The drilling assembly includes a drill bit positioned on a forward end to rotatably engage the formation, and a bias unit positioned rearward of the drill bit. The bias unit is connected with the drill bit for controlling the direction of drilling of the drill bit. The bias unit further includes an elongated tool body, a plurality of movable pads affixed to the tool body and which are extendable radially outward of the tool body to maintain contact with the borehole wall during rotation of the drilling assembly, and a sensor positioned to detect the relative position of the arm during extension.

Other aspects and advantages of the invention will be apparent from the following Description and the appended claims.

DETAILED DESCRIPTION

FIGS. 1-5 illustrate a rotary drilling installation and/or components thereof, embodying various aspects of the invention. For purposes of the description and clarity thereof, not all features of actual implementation are described. It will be appreciated, however, that although the development of any such actual implementation might be complex and time consuming, it would nevertheless be a routine undertaking for those of ordinary skill in the relevant mechanical, geophysical, or other relevant art, upon reading the present disclosure and/or viewing the accompanying drawings.

Figure 1:
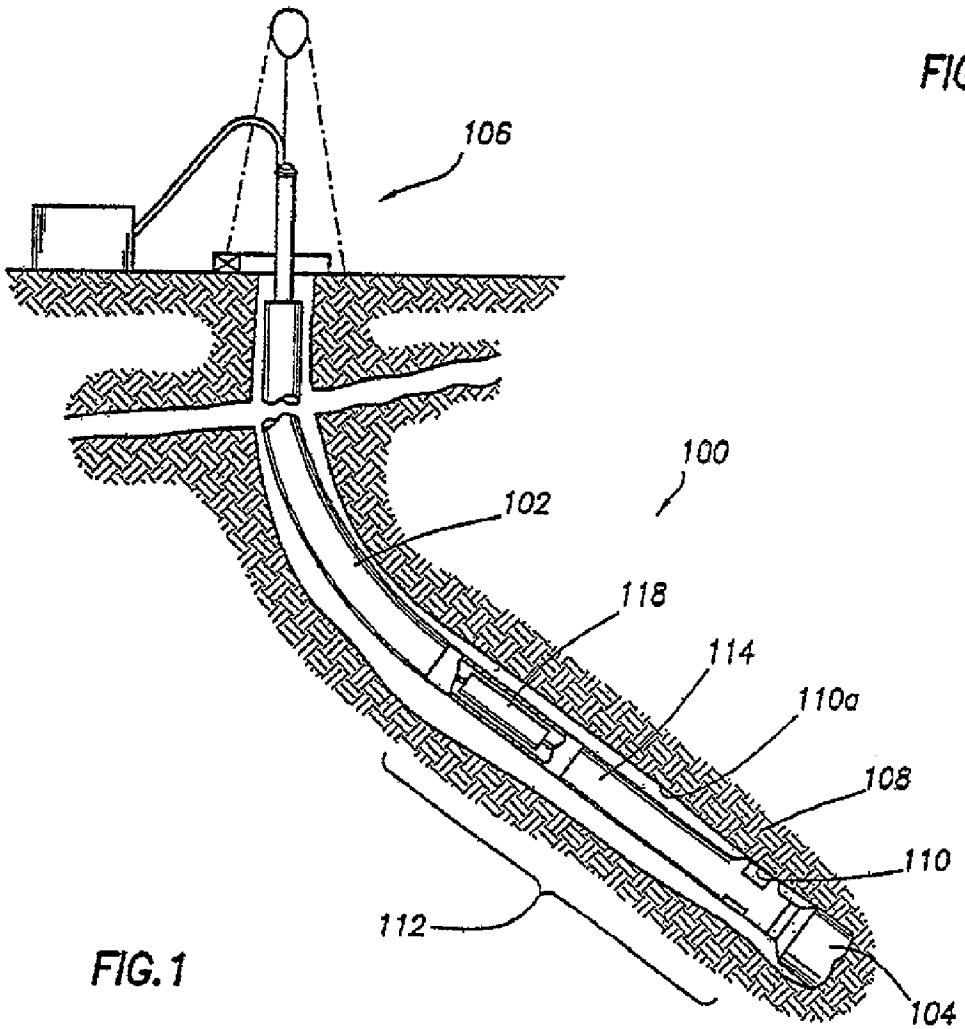
FIG. 1 is a simplified, diagrammatic section of a rotary drilling installation including a drilling assembly, according to the present invention.

FIG. 1 illustrates, in simplified form, a typical rotary drilling installation 100 suitable for incorporating and implementing the inventive system, apparatus, and/or method. The installation includes a drill string 102 having connected thereto, at a leading end, a drilling assembly 112 including a rotary drill bit 104. The drill string 102 is rotatably driven from a surface platform 106, by means generally known in the art, to penetrate an adjacent geological formation 108. The leading drilling assembly 112 which includes the drill bit 104, may be referred to as a bottom hole assembly ("BHA") 112. As the drill string 102 and the BHA 112 turn, the drill bit 104 engages and cuts the earthen formation. The bottom hole assembly 112 also includes a modulated bias unit 114 connected rearward of the drill bit 104. As is known in the art, the bottom hole assembly 112 also includes a control unit 118, which controls operation of the bias unit 114 (see e.g., U.S. Pat. Nos. 5,685,379 and 5,520,255). The bias unit 114 may be controlled to apply a lateral bias to the drill bit 104 in a desired direction, thereby steering the drill bit 104 and controlling the direction of drilling. The bottom hole assembly 112 further includes communications systems (e.g., telemetry equipment) for transmitting measurements and other data to the surface.

As used herein and in respect to the relative positions of the components of the bottom hole assembly 112, the directional term "forward" shall refer to the direction or location closer to the leading end of the drilling assembly 112 where the drill bit 104 is positioned. The relative term "rearward" shall be associated with the direction away from the leading or forward end.

Figure 2:
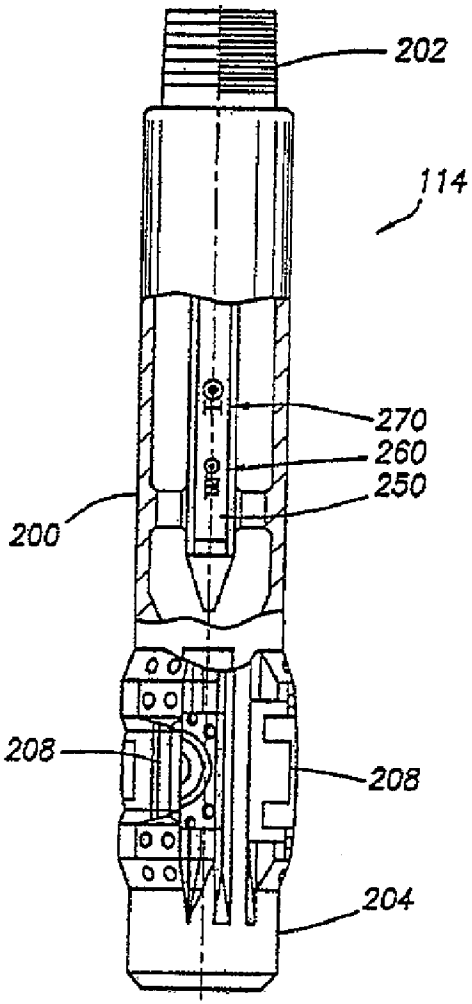
FIG. 2 is an elevation view of a drilling assembly of the kind with which the present invention may be applied and in accordance with the present invention.

Now referring to FIG. 2, a lower portion of the modulated bias unit 114 consists of an elongate support or tool body 200. The body 200 is provided, at an upper end, with a threaded pin 202 for connecting to a drill collar incorporating the control unit 118 (which is, in turn, connected to the forward or lower end of the drill string 102). A lower end 204 of the body 200 is formed with a socket to receive a threaded pin with the drill bit 104. The drilling assembly 112 of FIGS. 1 and 2 is of a rotary, steerable type operable to directionally drill a borehole 110.

Typical rotary drilling installations, drilling assemblies, and/or bias units are further described in U.S. Pat. Nos. 5,520,255 and 5,685,379. These patent documents provide additional background that will facilitate the understanding of the present invention and the improvements provided by the invention. In one aspect of the invention, the system and apparatus, as further described below, are particularly suited for modification of the rotary steerable system described in these patents. Accordingly, these patent documents are hereby incorporated by reference and made a part of the present disclosure.

The modular bias unit 114 is equipped around its periphery and toward the lower or leading end 204, with three equally spaced hinge pads or articulated caliper arms 208. The arms 208 are extendible outward by operation of a hydraulic actuator, spring device, or the like. A more detailed description of a typical hydraulic actuated hinge pad is provided in U.S. Pat. No. 5,520,255. Further reference should also be made to U.S. Pat. Nos. 3,092,188 and 4,416,339. These two patents provide detailed description of hinge pad devices, which are suitable for incorporation with the inventive system and apparatus and thus, provide specific background helpful in the understanding of the present invention. Accordingly, these patent documents are also hereby incorporated by reference and made a part of the present disclosure.

Figure 3:
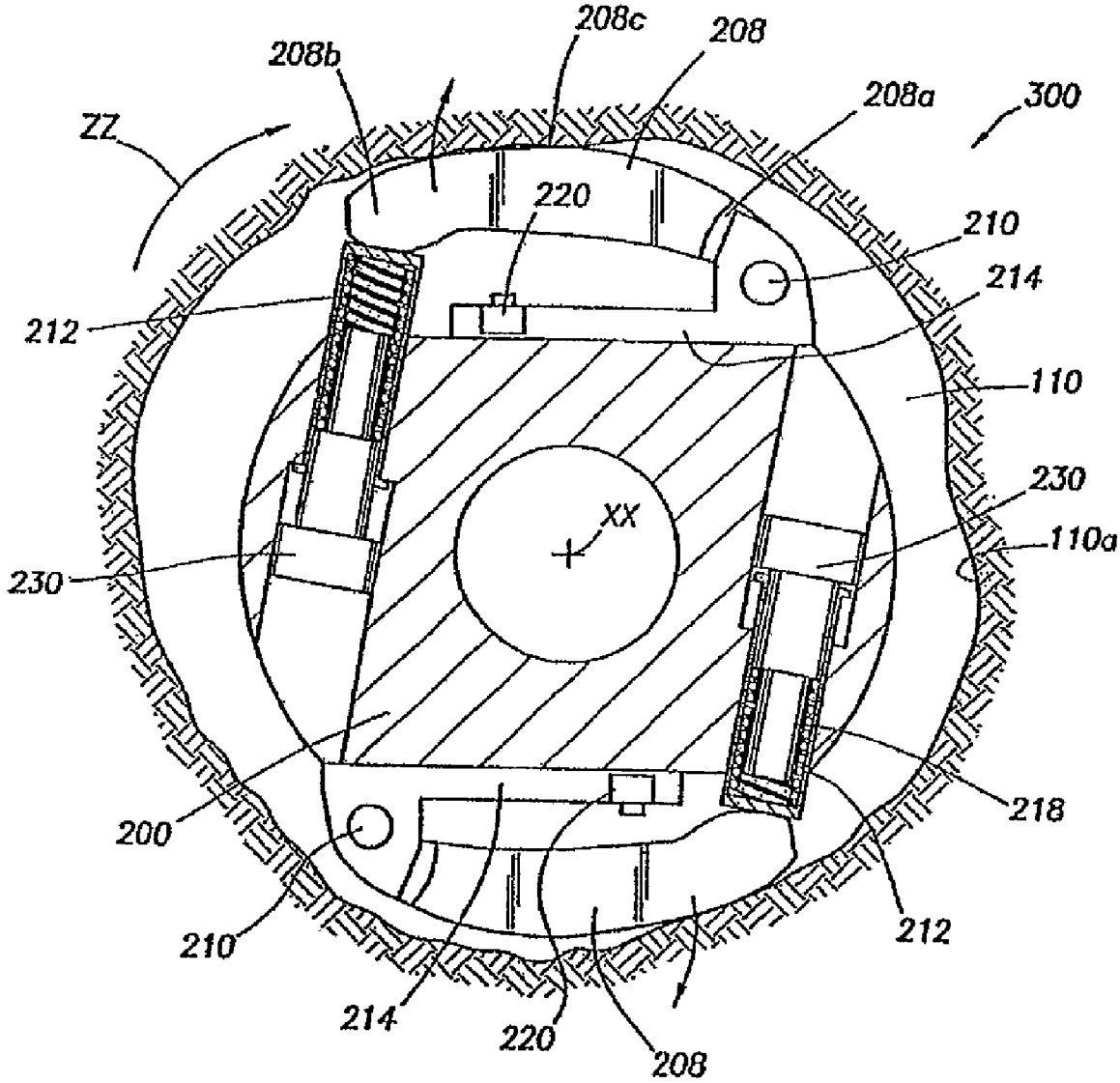
FIG. 3 is a simplified cross-sectional view of the drilling assembly in FIG. 2, according to the present invention.

The cross-section of FIG. 3 illustrates, in simplified form, the modular bias unit 114 modified to also function as a borehole measurement tool 300 according to the invention. The modular bias unit 114 is shown operating inside borehole 110 and rotating in the clockwise direction ZZ. During drilling of borehole 110, the tool 300 contacts a circumferential wall 110*a* of the borehole 110.

For purposes of the present description, the terms "borehole measurement" and/or "conducting measurements of a borehole" or "in a borehole" refers to physical measurements of certain dimensions of the borehole. Such measurements include borehole caliper measurements and borehole shape and profile determinations.

In a preferred embodiment, the borehole measurement tool 300 employs the hinged pads as caliper arms 208 for measuring the distance between the tool 300 and the borehole wall

110*a* at different angular and axial positions along the borehole wall 110*a*. The measurement tool 300 may have a plurality of caliper arms 208 positioned about the outer periphery of the tool body 200. The tool 300 of FIG. 3 employs two caliper arms 208. Each caliper arm 208 has a partly-cylindrical curved outer surface 208*c* and is pivotally supported on a support frame 214. The support frame 214 defines a cavity in which electrical and mechanical components operably associated with the arm 208 may be disposed, including a proximity sensor or probe 220 and a thrust pad or piston 218. Each arm 208 is hinged near a leading edge 208*a* and about a hinge pin 210 supported in the frame 214. The arm 208 is therefore, pivotally movable in the direction of rotation ZZ. The caliper arm 208 further includes a trailing edge 208*b* that is pivotally extendible to make contact with the borehole wall 110*a*.

The hinge pins 210 are oriented in parallel relation to a central longitudinal axis XX of the body 200. Preferably, the caliper arm 208 is movable by a linear actuator in the form of a linear spring-driven push rod 218. A linear spring 212 is incorporated into the push rod 218 and is positioned and preloaded to engage the caliper arm 208 proximate trailing edge 208*b* and urge the arm 208 radially outward against borehole wall 110*a*. The spring 212 is preloaded against a stationary body 230, which is secured into the body 200.

In an alternative embodiment, the spring 212 is activated by pressure within the tool 300 (i.e., when there is flow through the tool body 200). In this way, the springs 212 are designed to be in bias engagement with the arms 208 only when pumping flow is directed through the body 200. In the absence of flow, the arms 208 are retracted. In other embodiments, torsional springs acting about the hinge 210 axes or leaf springs acting between the tool body and the caliper arms are used.

As illustrated in FIG. 3, the circumference of the borehole wall 110*a* may be far from being circular (round) and the central axis XX of the body 200 may deviate from the center of the borehole 110. The spring bias maintains the trailing edge 208*b* of the caliper arm 208 in contact with the circumference of the borehole wall 110, throughout rotation of the drill string. When the caliper arm 208 encounters borehole circumferential variations while extended, the impact exerted by the borehole wall 110*a* pushes the trailing edge 208*b* (and the rest of the arm 208) to rotate back to a closed or retracted position. In this way, the caliper arm 208 tracks the borehole wall 110*a*, or more particularly, the diameter variations of the borehole wall 110*a*. The spring force is chosen to provide no more force than is necessary to ensure that the caliper arm 208 tracks the borehole wall 110*a*. This minimizes the effect of the caliper arm 208 on the dynamics of the drilling assembly 112.

In an alternative embodiment, wherein the inventive borehole measurement tool is incorporated with a modulated bias unit such as that described in U.S. Pat. Nos. 5,520,255 and 5,685,379, the caliper arms 208 are hydraulically operated hinge pads that, in conjunction with a control unit, also serves to steer the drill bit and thus, the drilling assembly. The unit employs a movable thrust member (e.g., a piston) and a hydraulic system for actuating the thrust member. In further embodiments, the caliper arms may be operated by a motor and coupling combination, springs, and the like.

Figure 5:
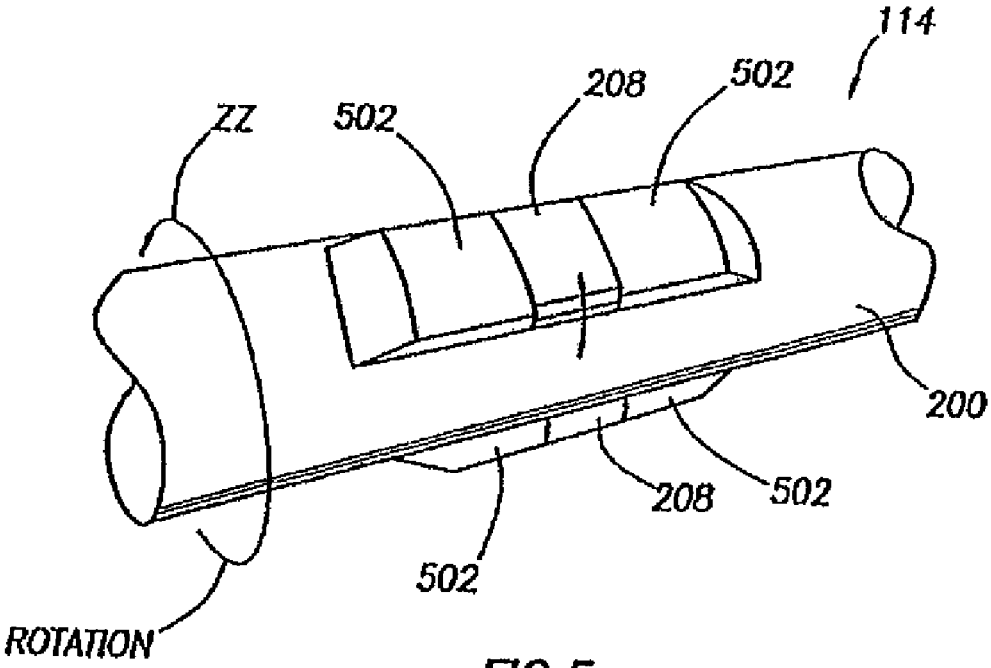
FIG. 5 is a simplified perspective of a section of the borehole measuring apparatus, according to the present invention.

Referring now to the simplified schematic of FIG. 5, the caliper arms 208 are preferably affixed to the side of the body 200 at equally spaced intervals. The caliper arms 208 are positioned outwardly of the normal surface of the body 200 and are rotatable about axes that are in parallel relation with the central axis XX. As shown in FIG. 5, the caliper arms 208 are preferably provided in a stabilizer blade or pad form with a curved outer surface.

More preferably, the unit 114 also employs kick pads 502 installed on either side (forward and rearward) of the caliper arms 208 to protect the caliper arms 208. The kick pads 502 are preferably solid metal deflectors that are very rugged and inexpensive to replace. The kick pads may also be formed or otherwise provided integrally with the body 200 and equipped with a wear-resistant coating (that may be re-applied as necessary). The kick pads 502 function to deflect axial impact from the caliper arms 208. Such impact may be encountered as the drilling assembly 112 treads inwardly or downwardly in the borehole 110. Preferably, the caliper arms 208 are slightly recessed below the working surface (or radial position) of the pads 502 when fully retracted and are able to extend outwardly to contact the borehole wall 110*a* even when the borehole 110 is enlarged beyond its normal size. This ensures that the caliper arms 208 maintain contact with the borehole wall 110*a*, while being protected from impact and abrasion on the body 200 when the tool body 200 makes forceful contact with the borehole wall 110*a*. By using blades or pads that are approximates the size of the borehole, the range of motion required of the arms 208 is minimized and the motion of the tool body 200 is restricted within the borehole 110.

In preferred embodiments, depicted particularly in FIG. 3, the measurement tool 300 employs a proximity probe 220 to monitor and/or measure the extension of the caliper arm 208 during travel of the tool body 200. As shown in FIG. 3, the proximity probe 220 may be installed adjacent the face of the tool body 200 in support frame 214 and directed toward the underside of the caliper arm 208. The proximity probe 220 is calibrated, as is known in the art, to sense the complete range of motion of 208, thereby obtaining the linear distance or movement of the caliper arm 208 from its rest position.

Figure 4:
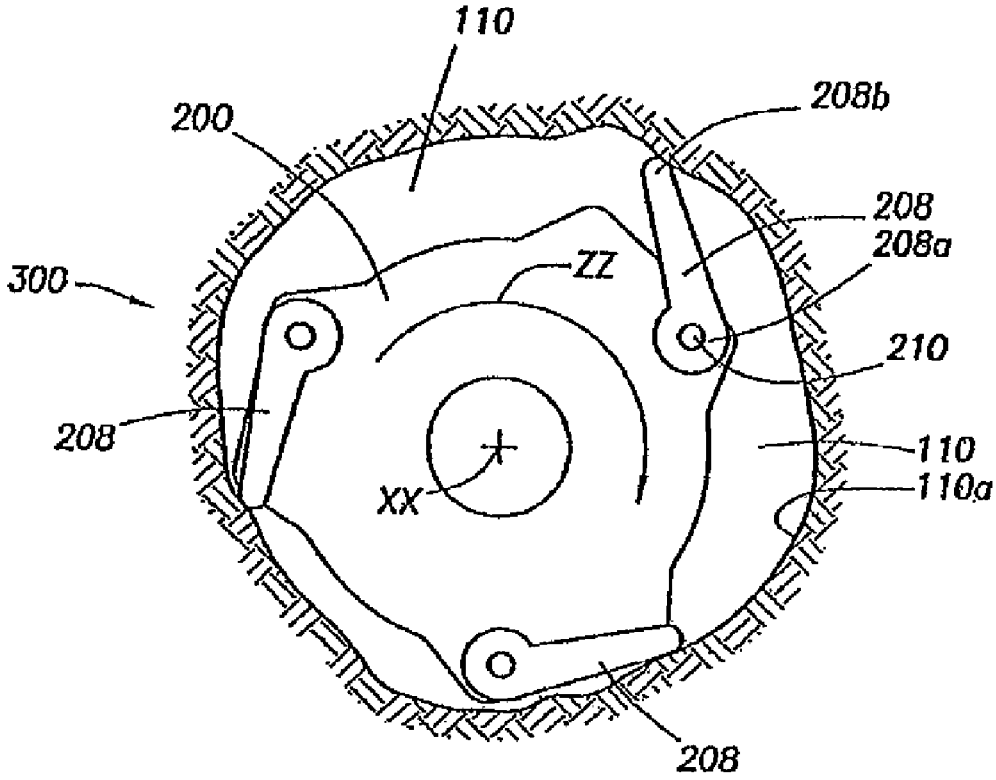
FIG. 4 is a simplified, cross-sectional view of an alternative borehole measuring apparatus, according to the invention.

FIG. 4 illustrates, in a simplified cross-section, an alternative embodiment of the present invention, wherein like reference numerals are used to refer to like elements. In particular, a measurement tool 300 is shown operating in the same borehole 110 and rotating in the clockwise direction ZZ. The tool 400 in this variation employs three spaced apart caliper arms 208 disposed about the periphery of the tool 300. In FIG. 4, the borehole 110 shown has a irregular circumferential profile. Accordingly, caliper arms 208 are extended radially outward at varying extent, so as to maintain urging contact with the borehole wall 110*a*.

Sensor selection, installation, and operation suitable for the present invention may be accomplished in several ways. In alternative embodiments, a linear transducer is linked to each of the caliper arms. In another embodiment, an angular transducer (e.g., a resolver or optical encoder) is placed inside the tool body and driven by the caliper arm hinge. In another embodiment, a sensor that provides a capacitance that is dependent on angle is used to measure the caliper arm 208 angles. In yet another embodiment, a linear transducer is embedded in the tool body, sealed by a bellows or pistons, and driven by a cam profile on the hinge pad or arm. In yet another embodiment, linear capacitance sensors are located between the arms and the meeting surfaces of the protective pads. In yet another embodiment, an electromagnetic signal is transmitted from an antenna embedded in a pad or blade and received by a second antenna embedded in the adjacent caliper arm (or vice-versa). A measurement of the absolute phase shift in the signal is used to determine the distance between the antennae, and therefore determine the caliper arm extension. For further understanding, reference may be made to U.S. Pat. No. 4,300,098 (herein incorporated by reference and made a part of the present disclosure).

It should be noted that each of the above methods of measuring or monitoring the position of the tool body or the caliper arm employs means that is known to one skilled in the relevant mechanical, instrumentation or geological art. Incorporation of these means into the modular bias unit or equivalent drilling tool will be apparent to one skilled in this art, upon reading and/or viewing the present disclosure.

In one method according to the invention for measuring the circumference of the borehole, the position of the tool body is assumed to be constant during rotation. As long as the bottom hole assembly is well stabilized, such an assumption is reasonably valid and the resulting measurements can be used to make a fairly accurate measurement of the borehole shape. In this method, the caliper measurements are used with simultaneous measurements of the angular orientation of the tool body. In cases where the bottom hole assembly is poorly stabilized, and is moving laterally within the borehole, it is preferred that multi-caliper arm designs are employed. Measurements from these multi-arm tools improve the quality of the measurement. In one embodiment, two diametrically opposed caliper arms are employed to directly caliper the borehole, while the bottom hole assembly rotates. This allows detection of borehole ovalization, although distortions in the derived borehole shape may still occur when the bottom hole assembly is not centralized. Accordingly, three or more arms may be employed as necessary to obtain more accurate and stable characterization of the borehole profile.

In some cases, even more accurate borehole measurements are obtained by employing a means for tracking movement of the tool body in the borehole, particularly lateral movement and deviation of the center axis XX from the center axis of the borehole. Such means is readily available and generally known to one skilled in the relevant art. In one embodiment, lateral movement (and thus the lateral position at any given time and/or borehole axial position) of the tool body 200 is tracked using a pair of accelerometers mounted generally perpendicularly to each other in a plane of the body 200 generally perpendicular to the longitudinal axis XX. The accelerometers provide measurements of the transverse or lateral acceleration of the tool body 200. These measurements are then numerically double integrated (to obtain, first, the velocity and second, the position) to calculate the change in the position of the tool body 200. These calculations are performed continuously throughout drilling, thereby tracking the position of the tool 300 at all times.

In addition, the angular orientation of the tool body 200 may be determined for each caliper arm extension measurements. The measurement tool 300 preferably employs a pair of magnetometers mounted in the same way (as the accelerometers) to measure the orientation of the tool body 200 with respect to the earth's magnetic field. More specifically, a pair of magnetometers are mounted generally perpendicular to one another and on a plane of the tool body that is generally perpendicular to the longitudinal axis XX. The rotation of the tool body 200 is tracked in this way.

In one embodiment, as illustrated in the cut-away section of FIG. 2, a rod-like chassis 250 is situated near an upper portion of the bias unit 114. The chassis 250 is preferably positioned coaxial with the central, longitudinal axis XX, and is provided with slots or cavities, in which sensors may be mounted. In this embodiment, a pair of accelerometers 260 and a pair of magnetometers 270 are mounted in suitable fashion in slots of the chassis 250. As described above, the accelerometers 260 and magnetometers 270 are employed to determine the lateral position and angular orientation of the measurement tool 300 (for corresponding caliper arm extension movements).

When the measurements of the tool body motion (lateral position) and angular orientation are combined with measurements of the caliper arm extensions, the location of the contact point of the borehole wall may be determined in respect to an initial reference frame. Thus, as the device rotates, it traces the true shape of the borehole at that particular axial position. The shape data is preferably recorded at regular intervals and stored in tool memory, for retrieval at the surface. The quantity of stored data may be reduced by comparison to previous sets of stored shaped data and only storing the new set of data when significant deviation is detected. In the alternative, data representing only the change in shape relative to the previous measurements may be stored. Such techniques are commonly used in digital image and video compression. As a further example, borehole shape data may be communicated to the surface in compressed form by way of a telemetry system incorporated into an MWD tool that is connected to the borehole measurement tool.

While the methods, system, and apparatus of the present invention have been described as specific embodiments, it will be apparent to those skilled in the relevant mechanical, instrumentation and/or geophysical art that variations may be applied to the structures and the sequence of steps of the methods described herein without departing from the concept and scope of the invention. For example and as explained above, various aspects of the invention may be applicable to a drilling device other than the modulated bias unit or drilling assembly described herein, such as an in-line stabilizer. All such similar variations apparent to those skilled in the art are deemed to be within this concept and scope of the invention as defined by the appended claims.

What is claimed is:

1. A method of conducting measurements of a borehole while drilling the borehole in a geological formation, the method comprising the steps of:

providing a rotatable drilling assembly having thereon, at a forward end, a drill bit and a borehole measurement tool connected rearward of the drill bit, the measurement tool including a pair of accelerometers mounted in a generally perpendicular relation on a plane of the measurement tool that is generally perpendicular to a longitudinal axis of the measurement tool; a pair of magnetometers positioned in a generally perpendicular relation on a plane of the measurement tool that is generally perpendicular to the longitudinal axis of the measurement tool; a caliper arm having a leading edge and a trailing edge, the leading edge pivotally connected with the measurement tool; and a linear actuator preloaded to engage the trailing edge of the caliper arm urging it outward from the measurement tool, the linear actuator comprising a spring-driven push rod oriented perpendicular to the longitudinal axis of the measurement tool;

drilling the borehole by operating the rotatable drilling assembly;

while drilling, contacting the wall of the borehole with the caliper arm;

measuring the extension of the caliper arm contacting the borehole wall, thereby determining a distance between the measurement tool and the borehole wall; and repeating the contacting and measuring steps at multiple positions of the drilling assembly during drilling.

2. The method of claim 1, wherein the contacting and measuring steps are performed at a plurality of angular positions of the drilling assembly.

3. The method of claim 2, further comprising the step of detecting the lateral position of the measurement tool in the borehole for each said measurement of the extension of the caliper arm.

4. The method of claim 3, wherein the detecting step includes measuring the lateral accelerations of the drilling assembly during drilling and deriving, from the measurements of lateral acceleration, the lateral positions of the borehole measurement tool.

5. The method of claim 1, further comprising the step of determining the angular orientation of the drilling assembly relative to the borehole for each the measurement of the extension of the caliper arm.

6. The method of claim 1, wherein the drilling step includes rotating the drilling assembly including the measurement tool, the method further comprising the step of maintaining contact between the caliper arm and the borehole wall during rotation of the drilling assembly.

7. The method of claim 1, wherein the measuring step includes operating a proximity probe to detect the position of the caliper arm.

8. The method of claim 1, further comprising the step of determining the angular position of the drilling assembly during each measuring step.

9. The method of claim 1, wherein the drilling step includes directing the drilling assembly forward in an angular direction deviating from the longitudinal axis of the borehole.

10. The method of claim 1, wherein the measurement tool includes a plurality of spaced apart caliper arms, the contacting and measurement steps being performed simultaneously with each arm and at different circumferential locations of the borehole wall.

11. The method of claim 10, wherein the plurality of arms are positioned about the periphery of the drilling assembly, such that during the contacting step, the drilling assembly rotates while the caliper arm maintains contact with the borehole wall.

12. The method of claim 1, wherein the contacting and measuring steps are performed in respect to a series of angular locations of the borehole wall, the method including deriving a circumferential profile of the borehole wall from the measurements at a common axial position in the borehole.

13. The method of claim 12, further comprising telemetrically communicating the measurements to the surface, during drilling.

14. The method of claim 12, further comprising the step of determining the angular orientation of the measurement tool relative to the borehole for each said measurement of the extension of the caliper arm by determining the orientation of the measurement tool relative to the Earth's magnetic field.

15. The method of claim 14, further comprising the step of detecting the lateral position of the measurement tool in the borehole for each said measurement of the extension of the caliper arm by measuring the lateral accelerations of the measurement tool during the contacting and measuring steps and numerically integrating therefrom to determine the lateral positions of the borehole measurement tool.

16. The method of claim 1, comprising the step of selecting a spring force of the spring-driven push rod to provide no more force than is necessary to ensure that the caliper arm tracks the wall of the borehole.

17. In a rotatable drilling assembly for drilling a borehole penetrating a geological formation, a borehole measurement apparatus comprising:

a support body integrated with the drilling assembly and rotatably movable therewith;

a caliper arm having a leading edge and a trailing edge, the leading edge pivotally affixed to the body;

a spring-driven push rod positioned and preloaded to engage the caliper arm proximate to the trailing edge to urge the caliper arm outward from the body to contact the borehole wall during drilling;

a sensor positioned proximate the caliper arm and operable to detect the distance between the extended arm and the support body;

a pair of accelerometers positioned in a generally perpendicular relation on a plane generally perpendicular to a longitudinal axis of the drilling assembly, the accelerometers positioned to detect the lateral accelerations of the support body; and a pair of magnetometers positioned to detect the orientation of the support body with respect to the Earth's magnetic field, the pair of magnetometers positioned in a generally perpendicular relation on a plane generally perpendicular to the longitudinal axis of the support body.

18. The apparatus of claim 17, further comprising a plurality of the caliper arm affixed to the periphery of the support body.

19. The apparatus of claim 17, wherein the sensor includes a proximity probe positioned to detect the relative position of the caliper arm.

20. The apparatus of claim 17, further comprising a protective pad positioned radially outward of the body and adjacent the caliper arm at an axial position forward of the caliper arm, the caliper arm being retractable to a recessed radial position beneath the radial position of the protective pad.

21. The apparatus of claim 20, further comprising a second of the protective pads spaced axially rearward of the caliper arm, the caliper arm being pivotally mounted between the first and second protective pads.

22. The apparatus of claim 17, further comprising a sensing device operatively associated with the support body to detect the angular orientation of the support body relative to the borehole wall.

23. The apparatus of claim 17, further comprising a sensing device operatively associated with the support body to detect the lateral position of the support body relative to the borehole.

24. The apparatus of claim 17, wherein the spring-driven rod is oriented generally perpendicular to the longitudinal axis.

25. The apparatus of claim 17, wherein the caliper arm is pivotally connected to the body by a pin oriented generally parallel to the longitudinal axis.

* * * * *